US005609298A

United States Patent [19]

Hyslop

[11] Patent Number: 5,609,298

[45] Date of Patent: Mar. 11, 1997

[54] EXHAUST NOZZLE ASSEMBLY FOR AN EXHAUST EXTRACTION SYSTEM

[76] Inventor: William J. Hyslop, 7708 Graham Rd., Indianapolis, Ind. 46250

[21] Appl. No.: 552,914

[22] Filed: Nov. 3, 1995

[51] Int. Cl.[6] ..... B05B 15/00

[52] U.S. Cl. ..... 239/289; 454/63; 285/9.1

[58] Field of Search ..... 239/600, 289; 285/9.1, 62; 454/63, 903; 141/383, DIG. 1

[56] References Cited

U.S. PATENT DOCUMENTS

| | | | |
|---|---|---|---|
| 2,733,668 | 2/1956 | Pfetzing | 104/52 X |
| 2,793,057 | 5/1957 | McGugin | 285/9 |
| 2,990,198 | 6/1961 | Imming | 285/9 |
| 4,102,254 | 7/1978 | Grant | 98/115 |
| 4,699,046 | 10/1987 | Bellieni | 98/115.4 |
| 4,796,520 | 1/1989 | Kramer, Jr. | 98/15.4 |
| 4,906,032 | 3/1990 | Hohman | 285/319 |
| 5,092,228 | 3/1992 | Pfeiffer, Jr. et al. | 454/63 |
| 5,096,230 | 3/1992 | Pausch et al. | 285/9.1 |
| 5,162,017 | 11/1992 | Nordin | 454/63 |
| 5,330,234 | 7/1994 | Sweeny | 285/62 |
| 5,362,273 | 11/1994 | Pfeiffer, Jr. et al. | 454/63 |
| 5,466,900 | 11/1995 | Knapp | 285/62 |

FOREIGN PATENT DOCUMENTS

| | | | |
|---|---|---|---|
| 1256813 | 4/1989 | Canada | 239/289 |

OTHER PUBLICATIONS

Advertising brochure of Harvey Industries, Inc., 1340 Home Ave., Akron, Ohio 44310 12 pages. (No Date Given).

Advertising brochure of Nederman, Inc., P.O. Box 278, McBee SC 29101, Westland, MI 2 pages. (No Date Given).

Advertising brochure of Tykron products, Roberts–Gordon, Inc., P. O. Box 44, Buffalo, NY 14240–0044; 241 South Service Road West, Grimsby, Ontario, Canada L3M1Y7 Oct. 1995; 4 pages. (No Date Given).

Advertising brochure of Plymovent, 375 Raritan Center Parkway, Edison, NJ 08837; 4 pages. (No Date Given).

Advertising brochure of Exhaustomatic Inc., P. O. Box 503444, Indianapolis, IN 46250; 1 page. (No Date Given).

*Primary Examiner*—Andres Kashnikow
*Assistant Examiner*—Lisa Ann Douglas
*Attorney, Agent, or Firm*—Woodard, Emhardt, Naughton Moriarty & McNett

[57] ABSTRACT

A magnetically-attached exhaust nozzle assembly for use as part of an exhaust extraction system for a fire truck includes an annular nozzle locator ring which is designed to slide over and secure to the exhaust pipe of the fire truck. The nozzle locator ring includes an inner sleeve which fits closely against the outside diameter of the exhaust pipe and an outer sleeve which receives a flexible exhaust nozzle. The exhaust nozzle is integrally connected with a flexible hose of the extraction system and establishes sealing engagement at two locations on the nozzle locator ring. There is axial sealing by abutment up against a flange of the nozzle locator ring and circumferential or radial sealing due to the fit of the nozzle on the outside surface of the outer sleeve. The flexible exhaust nozzle includes a guide rail which helps with the initial alignment and a magnet housing which ultimately attaches by magnetic attraction to the surface of the exhaust pipe for securely holding the nozzle in position. A spring-biased locator pin helps to keep the magnets of the magnet housing spaced from the exhaust pipe during initial assembly.

21 Claims, 7 Drawing Sheets

EXHAUST NOZZLE ASSEMBLY FOR AN EXHAUST EXTRACTION SYSTEM

BACKGROUND OF THE INVENTION

The present invention relates in general to exhaust extraction systems for emergency vehicles, such as a fire truck or ambulance. More particularly, the present invention relates to the design of a magnetically-attached nozzle which is designed to fit over the exhaust system tail pipe of an emergency vehicle.

Emergency vehicles, such as a fire truck, create an interesting exhaust-removal challenge due to the nature and manner of use of the vehicle in preparation for an emergency run. A fire truck is usually backed into the fire house garage bay and readied for its next run in this manner. When an alarm call comes in, the engine of the fire truck is started by the driver while he waits for everyone to prepare the equipment and get on board. During this brief time interval before the truck leaves the station, exhaust gases are generated and need to be vented to the outside atmosphere.

The exhaust system of a fire truck is typically arranged so that the "tail" pipe exits from the right side of the truck in front of the rear axle. While this location places the exiting exhaust gases near the center of the fire house, it is an advantageous location for present day exhaust extraction systems. For the most part these present day exhaust extraction systems use a flexible exhaust hose which is connected at one end to the fire truck exhaust pipe and at the opposite end to an overhead duct which leads out of the fire house. A high pressure blower is used to forcibly remove the exhaust gases from the fire house. A hose adapter or nozzle assembly of some type is typically used to connect the flexible hose to the exhaust pipe. With secure and sealed connections and so long as there are no perforations or open seams in the exhaust extraction system, all of the vehicle exhaust gases will be safely vented out of the fire house and into the atmosphere.

The use of a flexible hose to remove exhaust gas from a running engine is not new. Automobile mechanics have used such hoses for years. However, there is one important difference between use by a mechanic and use as part of an exhaust extraction system which is attached to an exhaust pipe of a fire truck. Once everyone is onboard the fire truck, it is ready to leave the fire house and there is usually no one left to disconnect the exhaust hose from the exhaust pipe. Even if personnel were left behind, safe handling of the vehicle exhaust would dictate that the vehicle be pulled out of the fire house and then have the hose removed. This would involve a start up and stop procedure at the very time the fire truck is trying to leave quickly on the emergency run. Even if someone was left behind and could disconnect the exhaust hose prior to the fire truck departing, this would allow exhaust gas to be dispersed into the fire house, the very event which exhaust extraction systems are designed to prevent.

In order to address this disconnect concern, present day exhaust extraction systems try to provide an automatic disconnect feature such that the adapter or nozzle connecting the flexible hose to the exhaust pipe comes off automatically after the fire truck has actually left the fire house. While present exhaust extraction systems which are offered commercially have approached this design challenge in slightly different ways, most systems provide an extra length of flexible hose which is suspended from an overhead track. A spring-biased balancer supports the hose and causes the release as the fire truck leaves the station. As the fire truck leaves, the distance between the exhaust pipe and the hose connection to the overhead duct increases. This pulls on the flexible exhaust hose which uncoils and the "surplus" length of hose is used. As the hose uncoils in order to stretch, the balancer uncoils which increases the resisting spring force. At some point, before the hose is completely extended, the resisting spring force of the balancer becomes greater than the force needed to separate the adapter from the exhaust pipe. Continued travel of the fire truck does not pull any more of the hose and the induced force on the adapter causes the hose adapter/nozzle to separate from the exhaust pipe. This occurs before the hose is fully extended which could place tension on the connection between the hose and the overhead duct.

The following companies have offered exhaust extraction systems which for the most part can be said to function in the manner which has been described: Harvey Industries, Inc., 1340 Home Avenue, Buildings F an G, Akron, Ohio 44310-2580; Nederman, Inc., P. O. Box 278, McBee S.C. 29101, Westland, Mich.; Tykron, 241 South Service Road, Grimsby, Ontario L3M1Y7, Canada; Plymovent, 375 Raritan Center Parkway, Edison, N.J. 08837; and Exhaustomatic, Inc., P. O. Box 503444, Indianapolis, Ind. 46250.

While the exhaust extraction systems offered by these listed companies are directed to solving the same problem, and while they can be said to generally perform in the same way, there are various design differences and different features which are offered. The overhead track and duct components, the balancer and the flexible hose are fairly well developed and would be considered as fairly mature technology. The "tail" pipe adapter though is an area of greater design attention. The desire is to provide a design which can be easily and securely attached to the exhaust pipe in order to connect the extraction system and yet release in a predictable and reliable manner without damage to the nozzle adapter, flexible hose or the exhaust pipe or for that matter any other portion of the vehicle or fire house.

The exhaust extraction system of Harvey Industries, Inc., connects the flexible hose to the exhaust pipe by a spring loaded clamp which is mounted on and extends through the nozzle. The nozzle is removed from the exhaust pipe when the balancer resisting spring force overcomes the clamp spring. The nozzle does not provide a seal around the exhaust pipe, but it does permit for ambient air to enter the nozzle.

The exhaust extraction system of Nederman, Inc., provides an electromagnetic attachment where a magnet attaches to the side of the fire truck and holds the nozzle opening at the exhaust pipe height. The nozzle does not provide a seal around the exhaust pipe but it does allow ambient air to enter the nozzle. In those fire station arrangements which use front and rear doors for a pass through bay, this system will not be suitable for that design.

The exhaust extraction system of Tykron uses a nozzle with a tension spring which rests in a groove inside the nozzle and surrounds the exhaust pipe. The nozzle spring does not provide a seal around the exhaust pipe, nor does it allow the maximum amount of air to enter in relation to its inside diameter size.

The exhaust extraction system of Plymovent uses a pneumatic bladder nozzle attachment concept. The bladder has three compartments and provides three points of pressure contact but does not form a complete seal around the exhaust pipe. The pneumatic bladder nozzle allows a very small volume of air to enter, but does not permit the maximum amount of air to enter. Consequently, with respect to the nozzle inside diameter size, this does not allow the complete system to operate at the lowest possible temperature. The described pneumatic system requires an air compressor, air filter and lubricator, air lines, controls, and the pneumatic bladder which adds to the overall cost and complexity of the system. It is believed that air leaks are a problem with this system and further, if the fire truck leaves the station at too fast a speed and the air has not been bled out of the nozzle bladder, the flexible hose can be damaged. Since there is a partial seal on the exhaust pipe, this can cause a two cycle turbocharger on a diesel engine to rotate without lubrication when the exhaust blower operates and all engines connected to the system are not running.

The exhaust extraction system of Exhaustomatic, Inc., actually has four variations as far as securing the nozzle to the exhaust pipe. Their product literature indicates that the four nozzle designs include a clamp design, permanent magnet design, electromagnetic design, and a pneumatic design. It is believed though that in these designs the nozzle does not provide a complete seal on the exhaust pipe. However, these designs do allow ambient air to enter and provide some system cooling, except when the pneumatic nozzle is used.

The present invention differs from these earlier designs in a number of novel and unobvious ways. The focus of the present invention is on two cooperating parts, the hose nozzle and a nozzle locator ring which connects to the exhaust pipe of the fire truck. While some preliminary work may need to be done to the exhaust pipe for connection to the nozzle locator ring, the invention novelty resides in the nozzle and the locator ring, not in any minor exhaust pipe modifications. What is desired is a nozzle design which readily and easily attaches to the vehicle exhaust pipe in a properly aligned fashion. This is where the nozzle locator ring becomes important. Once the nozzle is attached to the locator ring, it is preferred for ambient air to be drawn into the flexible hose of the extraction system when the extraction system exhaust blower is energized. Finally, a quick disconnect between the nozzle and the nozzle locator ring is desired without undue load or stress on any portion of the vehicle or on any portion of the exhaust extraction system. The present invention provides a hose adapter in the style of a flow nozzle which connects to a unique locator ring which is secured to the exhaust pipe. This combination is configured so as to address each of the desired performance criteria in a novel an unobvious way.

SUMMARY OF THE INVENTION

A magnetically-attached nozzle assembly for an exhaust extraction system according to one embodiment of the present invention comprises an annular nozzle locator ring which is constructed and arranged to slide onto a vehicle exhaust pipe, the nozzle locator ring includes an end flange and an annular inner stem which is substantially concentric with the end flange and the nozzle assembly further includes an annular exhaust nozzle which is constructed and arranged with an inside surface which fits around the annular inner stem and an end edge which abuts up against the end flange, the annular exhaust nozzle including a guide rail attached to the inside surface of the nozzle and a magnet housing which is attached to the inside surface of the nozzle.

One object of the present invention is to provide an improved nozzle assembly for an exhaust extraction system.

Related objects and advantages of the present invention will be apparent from the following description.

DESCRIPTION OF THE PREFERRED EMBODIMENT

Figure 1:
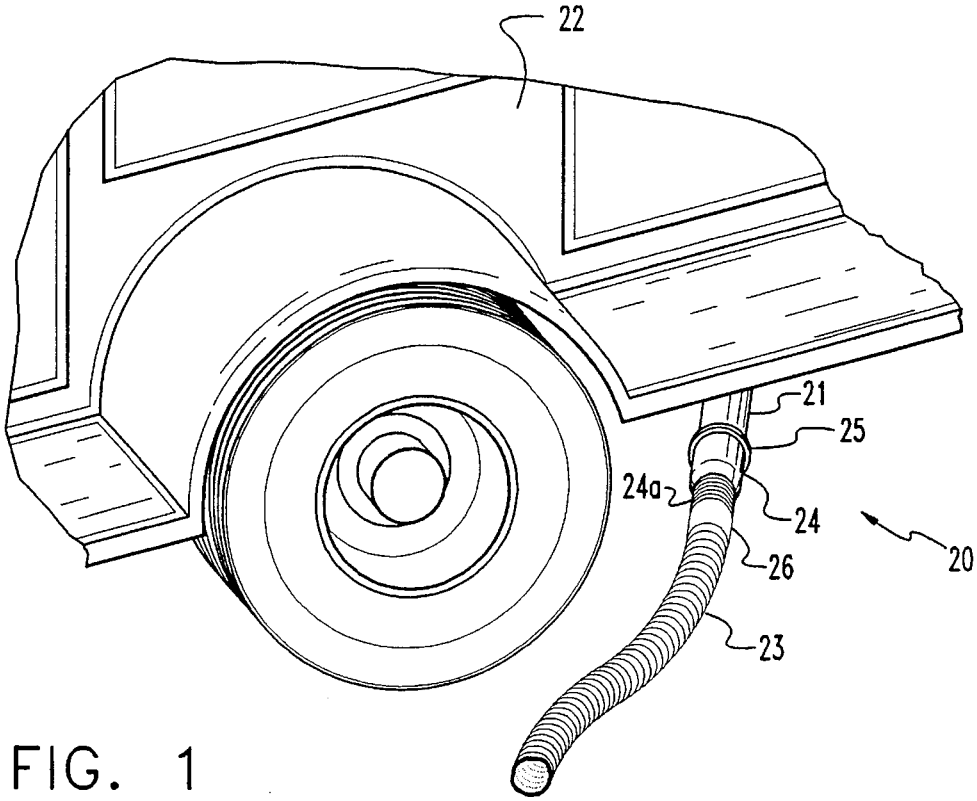
FIG. 1 is a partial perspective view of a fire truck exhaust pipe connected to an exhaust extraction system according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a portion of an exhaust extraction system 20 which is connected to the exhaust pipe 21 of a fire truck 22. The flexible hose 23 of the exhaust extraction system 20 terminates in a flexible nozzle 24 which is designed in accordance with the present invention. While the flexible hose 23 could connect directly to the end of nozzle 24, the anticipated arrangement is for a short section **24*a* of flexible hose to be formed in unitary construction with nozzle 24. This short section 24*a* is then connected to the main length of flexible hose 23 by means of a hose clamp 26, or some similar connection technique. A nozzle locator ring 25 is securely attached to the exhaust pipe 21 and remains fixed thereto. The nozzle 24 fits over the nozzle locator ring 25** and this interface denotes the point of separation when the exhaust extraction system disconnects from the vehicle.

The exhaust pipe 21 is configured so as to exit from the right side of the fire truck 22 between the front and rear axles. The exhaust pipe 21 is typically cylindrical and only extends beyond the side of the truck a relatively short distance. It is also to be noted that a properly configured exhaust pipe extends rearwardly at an approximate 45 degree angle which eases the separation of the nozzle from the exhaust pipe when the fire truck 22 leaves the fire house. As will be explained hereinafter, the specific style of the exhaust pipe is important and if the as-provided pipe on the vehicle is not of the desired size and shape or if it is not in the desired location, it will be necessary to modify the exhaust pipe in order for it to be compatible with the nozzle locator ring 25.

The remainder of the exhaust extraction system 20 which is not illustrated in FIG. 1 can assume a variety of configurations, depending on the specific brand or model which is being used in the particular fire house. However, a typical exhaust extraction system will include a high pressure blower, a round sealed duct, flexible hose of adequate length to extend between the system and the vehicle as it leaves the fire house, a hose support balancer, and a cooperating balancer track. Since existing exhaust extraction systems which are available commercially are believed to be well known to persons of ordinary skill in this field, the system details need not be illustrated. Various companies have been identified which offer such systems and their product literature illustrates to some extent these other components and confirms that these exhaust extraction systems are well known to persons of ordinary skill. Further, the only aspect of such commercial systems which is applicable to the present invention is the flexible hose 23. The flexible hose 23 and the end of the hose which terminates into nozzle 24 will typically have the same size, shape, and overall configurations, regardless of the exhaust extraction system.

Figure 2:
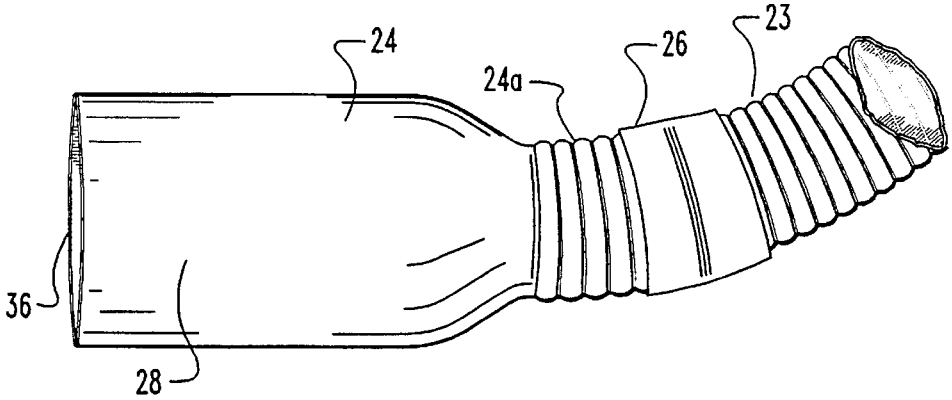
FIG. 2 is a side elevational view of the FIG. 1 exhaust nozzle and a portion of its integral flexible hose.

Referring to FIG. 2, nozzle 24 is illustrated in greater detail. Nozzle 24 is a hollow, generally cylindrical member which tapers into its unitary connection with flexible hose 24*a*. The size and shape of end 28 is designed to fit snugly over nozzle locator ring 25. Although the flexible hose short section 24*a* and nozzle 24 have been illustrated and described as having a unitary connection, it should be understood that the design of nozzle 24 for the present invention could be fabricated separately from the short section of flexible hose and thereafter connect these two components. However, a unitary connection simply eliminates one further point for mechanical failure and/or exhaust leakage. There is already one location of hose-to-hose mechanical connection which is effected by hose clamp 26 which joins short section 24*a* with flexible hose 23. It is also to be noted that nozzle 24 has a relatively thick wall but is still flexible and able to be manually shaped, to some extent, as it is pushed onto the nozzle locator ring 25.

The nozzle locator ring 25 (see FIG. 3) is an annular metal ring with an end flange 29, inner stem 30, and interior guide portion 31. End 28 of nozzle 24 fits securely over the outside diameter surface 34 of inner stem 30 and abuts up against the inside surface 35 of end flange 29. In this manner there are two points of sealing between the nozzle 24 and the nozzle locator ring 25. The first sealed interface is circumferential in nature and exists between the inside diameter of nozzle 24 and the outside diameter surface 34 of inner stem 30. The second sealed interface is axial in nature and exists between the outermost edge 36 of end 28 and inside surface 35 of the locator ring 25. Inner stem 30 includes a tapered, lead-in portion 37 and a cylindrical portion 38. The flexibility of the heavy gauge rubber used for nozzle 24 allows the nozzle to adapt to any slight variations in the diameter size or cylindricity of portion 38 so that there is a gas-tight seal at this first sealed interface. By pushing the nozzle 24 all the way into abutment against surface 35, a second sealed interface is provided for added security and reliability.

In lieu of the illustrated relationship between the end 28 of nozzle 24 and the inside surface 35 of end flange 29, it is possible to reduce the outside diameter size of flange 29 so that it is flush with surface 34. Thereafter, weld four, equally-spaced, L-shaped angle brackets adjacent to the outer edge of flange 29. The L-shaped angle brackets will extend above surface 34 and end 28 of nozzle 24 will rest against them when in position. These four angle brackets will securely attach the nozzle locator ring 25 to the exhaust pipe by means of four two-way locator pins.

The interior guide portion 31 of locator ring 25 is a circumferential sleeve which extends from and is aligned with the inside diameter opening 41 centered in end flange 29. The inside diameter opening 41 and guide portion 31 establish a receiving bore for the exhaust pipe of the vehicle. If the diameter sizes of the receiving bore and exhaust pipe are not compatible, the exhaust pipe can be sleeved to build it up to the required size, rigidly securing the sleeve to the exhaust pipe as a permanent addition.

Figure 3:
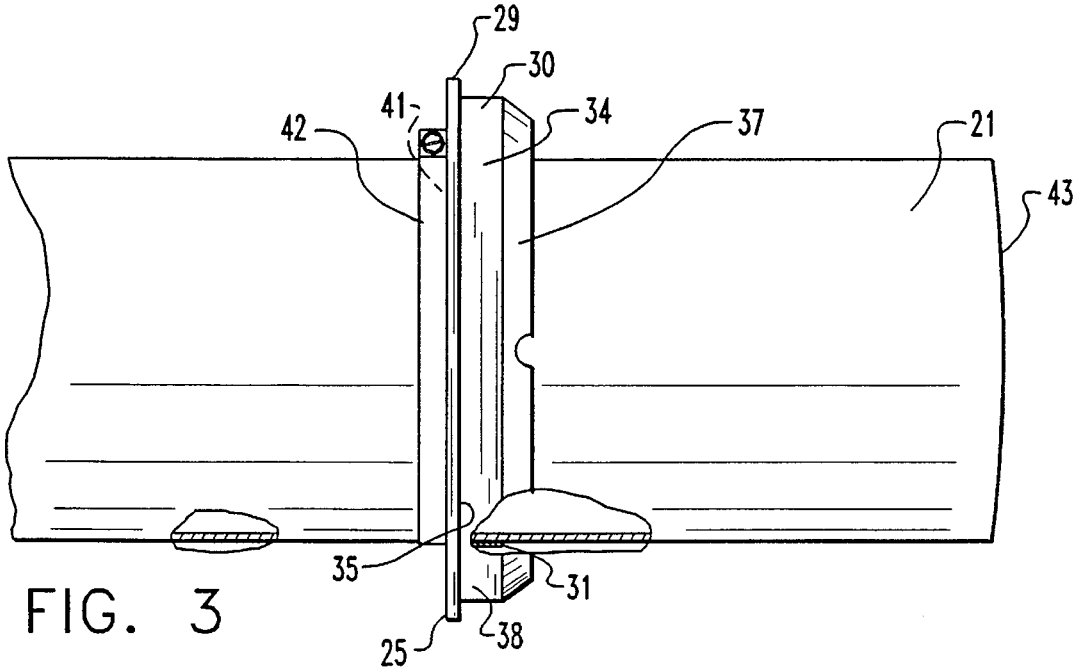
FIG. 3 is a fragmentary side elevational view of the FIG. 1 nozzle locator ring as attached to the exhaust pipe.

Assuming properly sized components, the nozzle locator ring 25 is designed to slide onto the exposed end of the exhaust pipe 21 with somewhere between a line-to-line or snug slip fit and is then attached to the exhaust pipe or otherwise anchored to the pipe in a secure fashion. The locator ring 25 can be held in position on the exhaust pipe with locator blocks welded to the exhaust pipe or simply pinned. Another option is to use a pair of band clamps 42, one of which is illustrated in FIG. 3. The second band clamp, which is not illustrated, would be used on the opposite side of the nozzle locator ring so as to preclude any axial movement of the locator ring 25 along the pipe. Virtually any configuration which securely attaches the nozzle locator ring to the exhaust pipe is suitable for use and compatible with the present invention.

Figure 4:
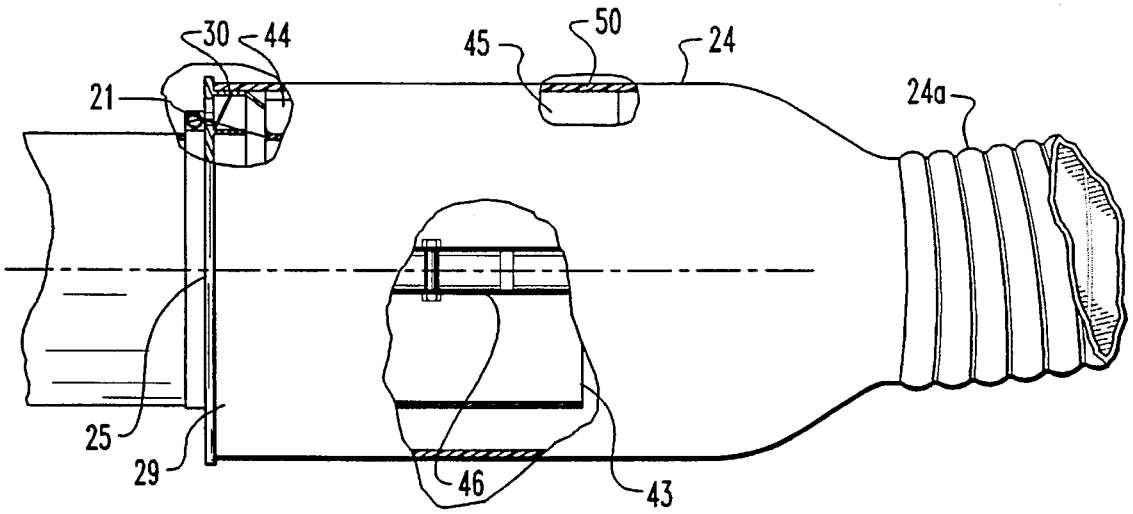
FIG. 4 is a fragmentary side elevational view of the FIG. 2 nozzle as attached to the FIG. 3 nozzle locator ring.

With the nozzle locator ring 25 securely positioned on the exhaust pipe 21, the nozzle 24 slides on with a snug, gas-tight fit. The overall assembly is illustrated in FIG. 4 which has an orientation similar to that of FIG. 1. As is illustrated, the free end 43 of the exhaust pipe 21 is positioned in the center of nozzle 24 and is substantially concentric with the nozzle 24. There is as a result of this arrangement a substantially annular clearance space 44 which surrounds the exhaust pipe 21 on the inside of nozzle 24. This annular clearance space is used for a guide rail 45 and a magnet housing 46, see FIGS. 5, 5A, and 6. Also positioned on the interior of the nozzle is a support rod 47 which extends across the nozzle opening and provides support for the nozzle to help it maintain its generally cylindrical shape. Support rod 47 is attached to internally-threaded spacers 48, one at each end of the rod. The opposite end of each spacer is secured in position adjacent the inside wall of the nozzle by screws 49 which extend through the nozzle side wall 50. One spacer fits against a bracket flange portion of the magnet housing and this flange is clamped between the spacer and the inside surface of sidewall 50. The heads of screws 49 and the outermost end of the other spacer 48 securely clamp against the outside and inside surfaces of sidewall 50. However, it is possible to adjust the overall length of this rod/spacer combination by varying the extent of threaded engagement of rod 47 into the two spacers 48. It is also possible to use jam nuts on threaded rod 47 and draw these into tight abutment up against each of the two spacers 48 as a final means of securement and to preclude any loosening of the overall assembly due to vibration.

Figure 9:
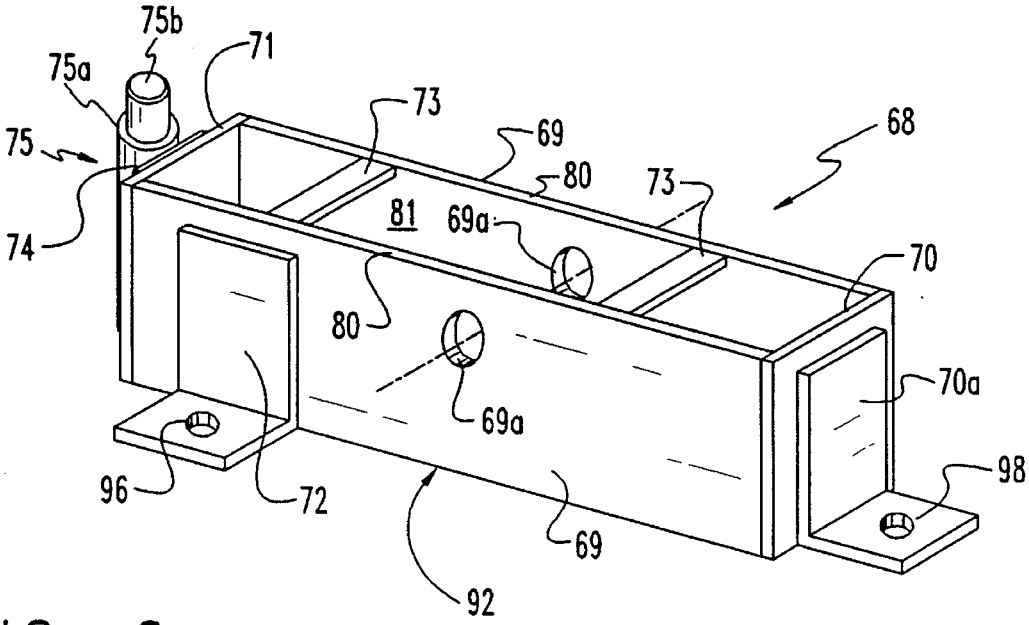
FIG. 9 is a perspective view of a magnet block frame which comprises a portion of the FIG. 2 nozzle.

As the nozzle 24 slides onto the free end 43 of the exhaust pipe 21, the guide rail 45 contacts the outside diameter surface of the exhaust pipe and helps to maintain alignment between the nozzle and the exhaust pipe as the nozzle is pushed into position on locator ring 25. The magnet housing 46 which holds a plurality of magnets and magnet plates also is able to ride across the outside diameter surface of the exhaust pipe. However, as is illustrated in FIG. 9, the magnet housing is designed with a spring-biased pin held within a concentric sleeve. With the pin extended, the pin will actually slide across the outer surface of the exhaust pipe and this maintains a slight separation between the exhaust pipe and the magnets within magnet housing 46. The result of this arrangement is to cause the nozzle to slide over the exhaust pipe in a non-concentric fashion until the nozzle is close to its final position and secured onto the nozzle locator ring 25. By manually compressing the nozzle 24, the spring-biased pin will be retracted into its surrounding sleeve, allowing the magnets to come into contact with the exhaust pipe for magnetic attachment thereto.

Figure 5:
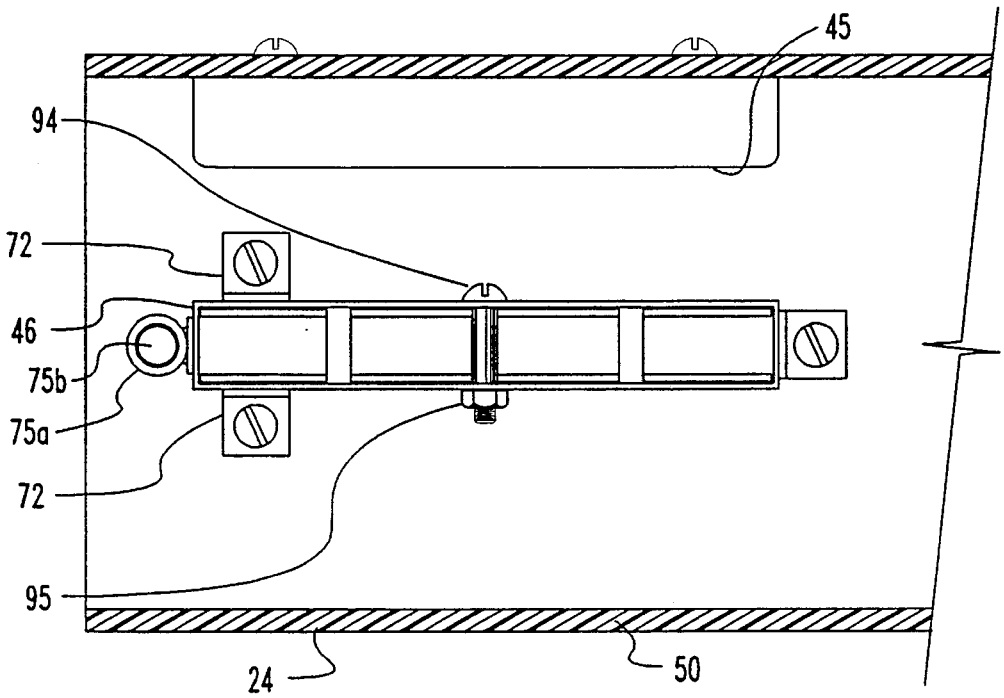
FIG. 5 is a partial side elevational view in full section of the FIG. 2 nozzle.
Figure 5A:
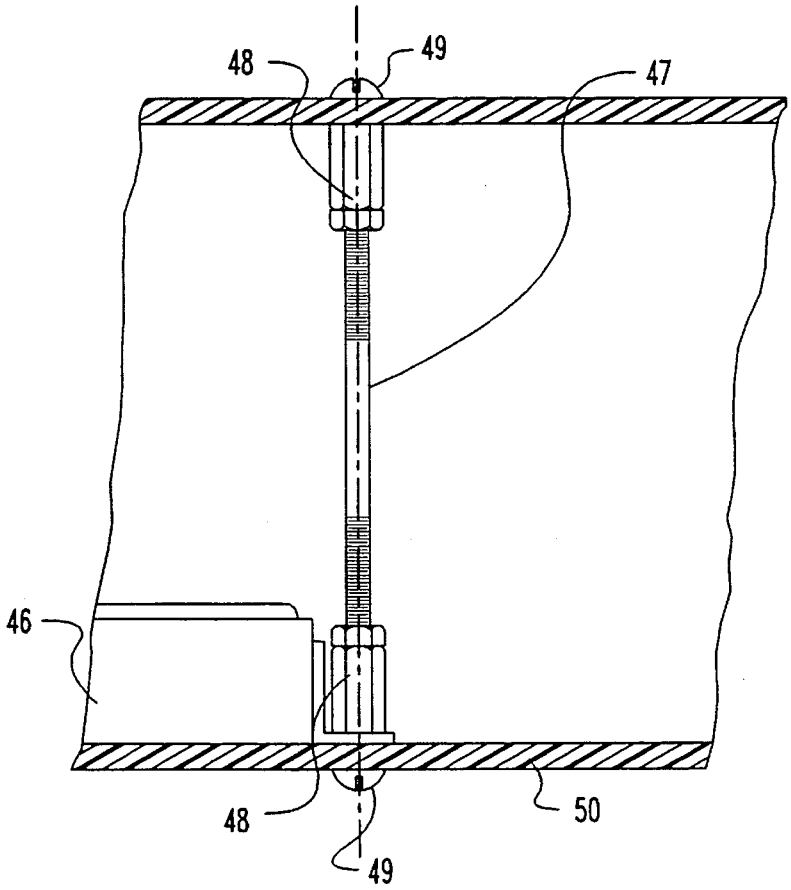
FIG. 5A is a partial side elevational view in full section of the FIG. 2 nozzle which is rotated 90 degrees from the FIG. 5 orientation.
Figure 6:
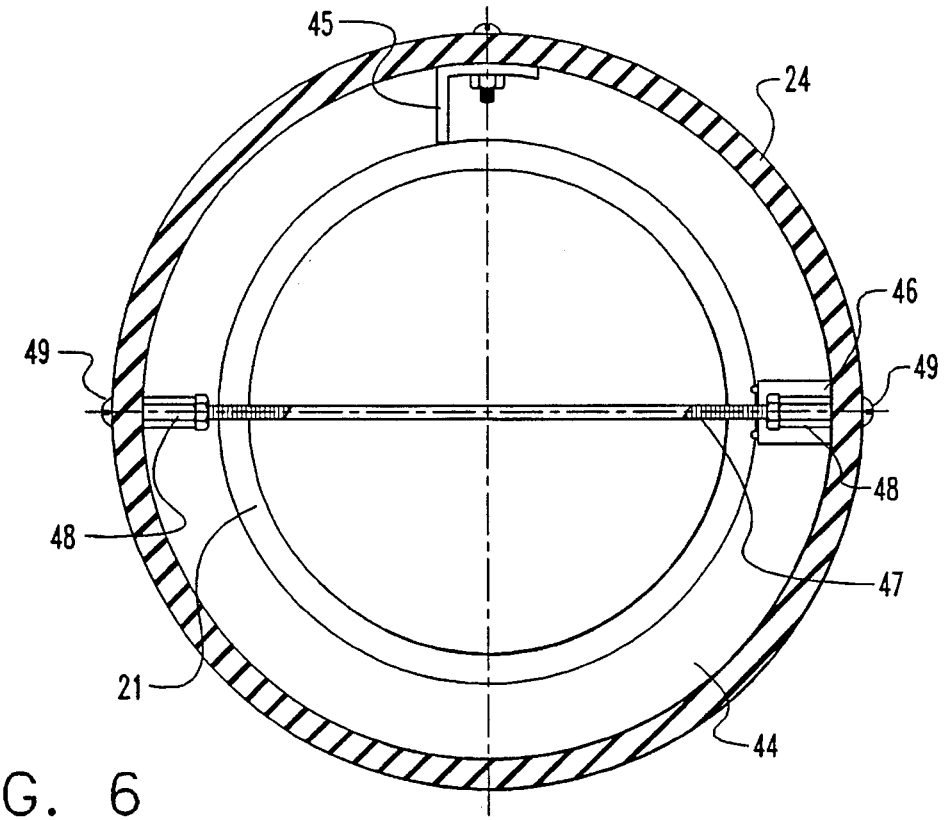
FIG. 6 is an end elevational view of the FIG. 2 nozzle viewed in the direction of the nozzle as it would be inserted onto the FIG. 3 nozzle locator ring.

Although the design of nozzle 24 and its interior components has been described, a few comments with regard to FIGS. 5, 5A, and 6 may be helpful in order to understand the orientation and location of the various interior components. As described, nozzle 24 is substantially cylindrical and thus its orientation relative to the drawing figures is relevant. The FIG. 4 illustration was intended to orient the nozzle onto the exhaust pipe and locator ring in the same manner as it would be typically installed in actual use. The nozzle comes in from the right-hand side of the illustration and is pushed over the free end 43 of exhaust pipe 21. In this particular orientation, the guide rail 45 will be positioned on the top or what might be referenced as a twelve o'clock or top dead center location. Due to the L-shaped arrangement of guide rail 45, its downward or depending portion (see FIGS. 5 and 6) may actually be oriented more at an eleven-thirty location. It is this depending portion of guide rail 45 which actually contacts and rides across the outer surface of exhaust pipe 21. The magnet block 46 is located 90 degrees from the mounting location for the guide rail and thus would be at a three o'clock location as generally illustrated in FIG. 6. Consequently, the FIG. 4 orientation illustrates the magnet block 46 on the back or far side of the nozzle 24. This agrees with the FIG. 5 orientation which shows both the guide rail 45 at its top dead center location and the magnet block 46 on the back wall of the nozzle. In the FIG. 5A illustration, the FIG. 5 orientation for the nozzle has been turned 90 degrees so as to place the magnet block at the bottom dead center position. The threaded rod 47 which is illustrated in FIG. 5A and in FIG. 6 has been omitted in the FIG. 5 illustration for drawing clarity. Further, the FIG. 5 orientation would be as viewed from the left side of FIG. 6.

Figure 7:
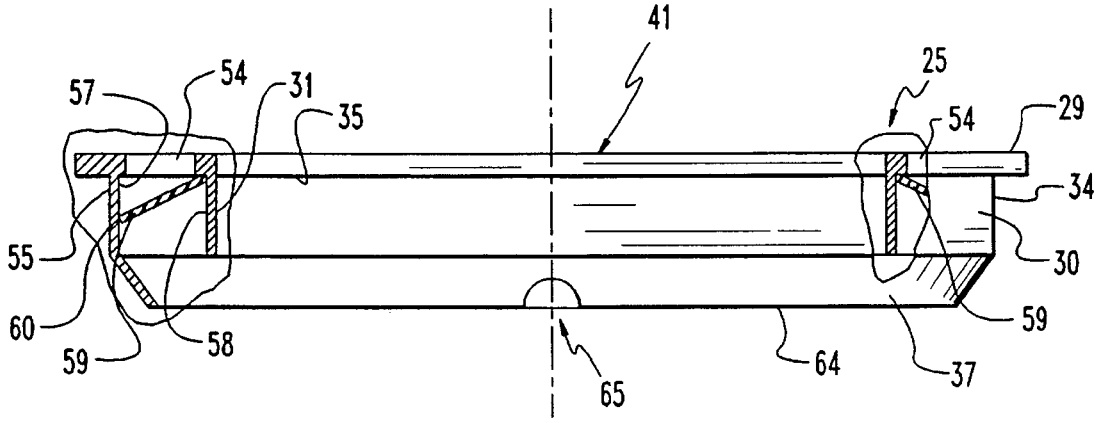
FIG. 7 is a fragmentary side elevational view of the FIG. 3 nozzle locator ring turned 90 degrees from the FIG. 3 orientation.
Figure 8:
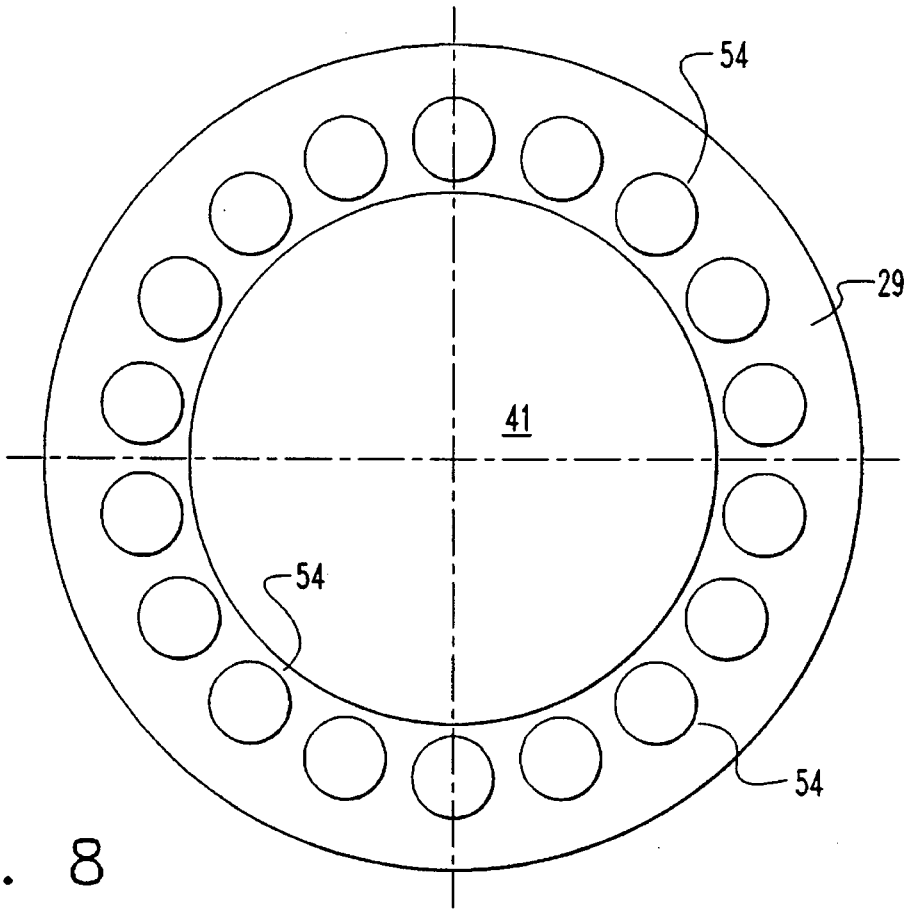
FIG. 8 is a top plan view of the FIG. 7 nozzle locator ring.

Nozzle locator ring 25 is illustrated in greater detail in FIGS. 7 and 8. Locator ring 25 has an annular ring shape with virtually all portions being both annular in shape and substantially concentric in position relative to the other portions of the locator ring 25. End flange 29 is approximately 6⅝ inches in outside diameter and is approximately ⅛ inch thick. The inside diameter opening 41 is approximately 4 inches in diameter. The end flange 29 defines a circular pattern of eighteen equally spaced ¾ inch diameter clearance holes 54. The inner stem 30 includes a substantially cylindrical portion 55 which includes outside diameter surface 34. Lead-in portion 37 is integral with portion 55 and the wall thickness of each portion is approximately 1/16 inch. Inset from portion 55 and substantially concentric therewith is interior guide portion 31. Portion 31 is substantially cylindrical with a wall thickness of approximately 1/16 inch. The inside diameter of portion 31 is coincident with the inside diameter opening 41 and portion 31 axially extends for approximately ½ inch beyond the proximal surface 35 of end flange 29.

The pattern of eighteen clearance holes 54 is substantially centered coaxially, between the inner surface 57 of portion 55 and the outside surface 58 of portion 31. Positioned and extending between surfaces 57 and 58 and located adjacent to end flange 29 is a rubber flapper ring 59. By means of a high temperature, flexible adhesive, the inside diameter of flapper ring 59 is glued to outer surface 58. The annular flapper ring 59 is fixedly attached in the corner defined by the junction of outer surface 58 and proximal surface 35. The remainder of the flapper ring 59 extends downwardly and outwardly at a slight incline or deflection. The outer edge 60 of flapper ring 59 makes sealing contact against inner surface 57. As would be understood from this described and illustrated structure, flapper ring 59 creates a one-way air flow restricter. Air flowing from the atmosphere into clearance holes 54 will push against flapper ring 59 causing it to deflect away from the clearance holes and away from surface 57, thereby allowing the ambient air to enter the nozzle 24 and subsequently blend with the exhaust exiting from the exhaust pipe 21. The blending of ambient air with the hot exhaust tends to lower the overall temperature of the exhaust which is being routed out of the fire house by the flexible hose 23. A lower overall temperature is easier on the nozzle and flexible hose and contributes to their longer life. Ambient air is drawn in through the clearance holes 54 whenever the blower of the exhaust extraction system starts. Ambient air may also be drawn in through any pressure differences or a possible Venturi effect of exhaust flowing from the exhaust pipe.

In the reverse direction, any air or exhaust gas which might tend to backflow from the nozzle back to the atmosphere will be blocked by flapper ring 59. The flow of air or exhaust gas inside of nozzle 24 will simply push against the flapper ring, pushing it back toward the clearance holes 54 and edge 60 up against surface 57. The flexibility of the rubber flapper ring 59 enables it to seal up against the clearance holes and/or up against surface 57, preventing any backflow out through the clearance holes 54.

The lower edge 64 of lead-in portion 37 includes an alignment notch 65. Notch 65 is semi-circular in shape and has a full radius curvature of approximately ½ inch. As will be explained hereinafter, this alignment notch 65 cooperates with the magnet housing 46 in order to help properly position the nozzle 24 over the exhaust pipe 21 and onto the locator ring 25.

Figure 10:
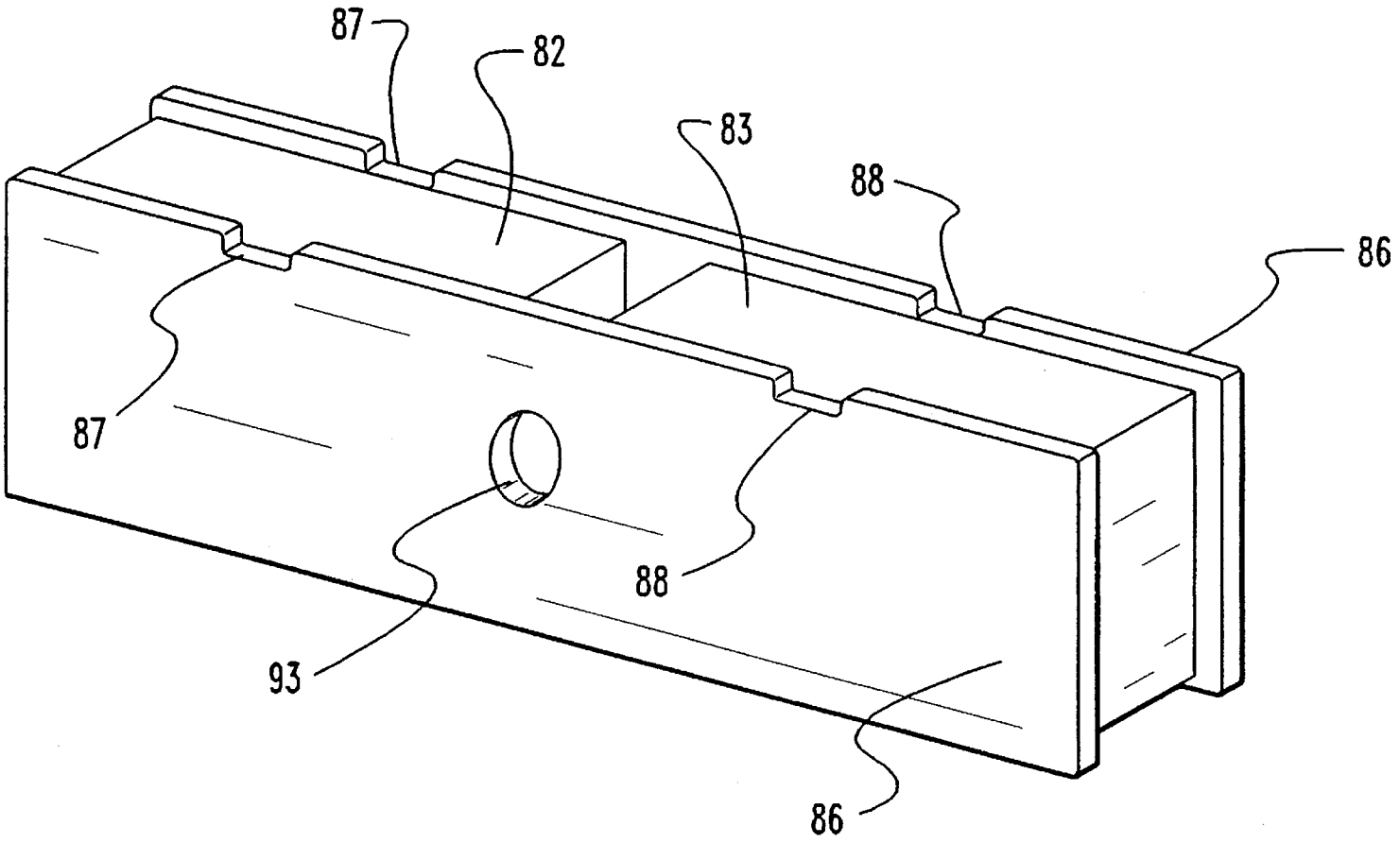
FIG. 10 is a perspective view of a magnet subassembly which fits within the FIG. 9 frame.

The magnet housing 46 of nozzle 24 is illustrated in greater detail in FIGS. 9 and 10. The magnet housing includes a frame 68 (see FIG. 9) which is fabricated as a welded assembly. The component parts of frame 68 include two side panels 69, two end panels 70 and 71, two side mounting brackets 72, and two cross brackets 73. End panel 70 may be arranged as an L-shaped bracket whose upper portion is welded to one end of each of the two side panels 69. An alternative construction and the construction illustrated in FIG. 9 is to use a separate L-shaped bracket 70*a* which is welded up against end panel 70. End panel 71 likewise may be welded directly to the opposite ends of the two side panels 69 and in turn pin/sleeve combination 75 may be welded directly to end panel 71. An alternative construction and the one illustrated in FIG. 9 is to use an intermediate and substantially flat plate 74 which is welded to end panel 71 and in turn the captured, spring-biased pin/sleeve combination 75 is welded to the approximate center of plate 74.

With regard to the pin/sleeve combination 75, there is a generally cylindrical outer sleeve 75*a* which receives in a captured fashion a floating, spring-biased pin 75*b*. This construction is typical of a spring plunger type of design where axial pressure on the pin allows it to compress down into the sleeve and when the exterior force is removed, the biasing spring returns the pin to an outwardly extending orientation.

Pin 75*b* has already been referred to previously as the mechanism which allows the nozzle to slide over the exhaust pipe 21 without magnetic attachment. Only after pin 75*b* is compressed down into sleeve 75*a* will the magnets within magnet housing 46 be placed in magnetic attraction contact with the exhaust pipe. The outside diameter surface of sleeve 75*a* is welded along one side to the center of plate 74. The outer surface of sleeve 75*a* is used to line up with and fit into notch 75.

The two cross brackets 73 are welded to the upper edges 80 of the two side panels across open area 81. Clearance holes 69*a* are used with an elongated screw to assemble and retain the arrangement of magnets and side plates illustrated in FIG. 10. Although referred to as "upper" edges 80, it should be understood that when the nozzle 24 is assembled onto the locater ring, these "upper" edges will be directed inwardly and placed in contact with, or at least in close proximity to, the outside diameter surface of the exhaust pipe 21.

The open interior 81 of the frame 68 receives a pair of magnets 82 and 83 which are positioned between and magnetically attached to two substantially parallel and spaced-apart magnet plates 86 (see FIG. 10). The two magnet plates 86 each include a pair of notches 87 and 88 which are sized and arranged to fit beneath and around the two cross brackets 73. Each magnet plate is fabricated out of ⅛ inch thick steel and thus these plates are magnetically attracted to the two magnets 82 and 83 and this combination of four components thus becomes anchored together as a subassembly. Due to the fact that the bottom portion 92 of frame 68 is open, the FIG. 10 subassembly is able to slide up into frame 68 with the two cross brackets fitting into notches 87 and 88. Circular apertures 93 in the two magnet plates 86 are aligned with apertures 69*a* in the two side panels 69. As described, a single screw 94 is inserted through all four apertures and secured with a hex nut 95. This screw serves as a pivot point for the overall assembly of magnet housing 46. The use of this elongated screw as a pivot line for the assembly actually allows the two magnet plates 86 and the two magnets 82 and 83 to be pivoting or floating within the frame. While the magnets and magnet plates are not free and are clearly held in position by cross bracket 73 on one side and the nozzle wall on the opposite side, this ability to pivot slightly helps with the alignment and contact of the magnets against the outer surface of the exhaust pipe.

End panel 70*a* includes a mounting hole 98 which receives one mounting screw 49 for spacer 48. This spacer receives one end of the threaded support rod 47. In this manner, the same hardware used to secure one end of the support rod also secures one end of the frame 68 to the inside wall surface of the nozzle. The mounting holes 96 in the two side mounting brackets 72 are used to secure the frame 68 to the inside surface of the nozzle by the use of conventional screws, washers, and hex nuts.

In order to use the nozzle and nozzle locator ring of the present invention, the first requirement is to have a properly sized and located exhaust pipe. Sleeves can be used to scale up the outside diameter size of smaller exhaust pipes for receipt of the nozzle locator ring 25. The next step is to slide the nozzle locator ring 25 onto the exhaust pipe and secure the locator ring in position. Next, the nozzle and flexible hose are assembled onto the locator ring. The first step is to place guide rail 45 in contact with the exhaust pipe 21 in an approximate twelve o'clock position or what has been referred to as a top dead center location. This then places the magnet housing 46 at an approximate three o'clock location based upon an orientation of looking in at the free end of the exhaust pipe. Pin 75*b* of the spring-biased pin/sleeve combination 75 is fully extended at this point and rides up against the outside diameter of the exhaust pipe. The extended length of pin 75*b* causes the nozzle to initially assume a non-concentric orientation relative to the exhaust pipe. The extended pin 75*b* also prevents the magnet plates 86 from contacting the exhaust pipe, thereby making assembly of the nozzle 24 onto the locator ring 25 a relatively easy task.

When the sleeve 75*a* abuts up against lower edge 64 of portion 37, the nozzle is then turned until the sleeve 75*a* drops into alignment notch 65. Once the nozzle 24 is properly aligned radially, the flexible nozzle is forced onto the locator ring up against flange 29 to establish a substantially concentric relationship. At this point the spring has retracted and the magnet plates 86 contact the outside diameter surface of the exhaust pipe. The nozzle abuts up against the inside surface 35 in the axial direction and seals around the outside diameter surface 34 in the radial direction. In the preferred arrangement a gas-tight seal is also achieved against surface 35. The nozzle is held on the locator ring due to a slight interference fit at these two gas-tight interfaces. The nozzle is more securely held onto the exhaust pipe by the described magnetic attraction. A second magnet housing can be used instead of guide rail 45 to provide enhanced magnetic attraction to accommodate larger exhaust pipes.

When the fire truck leaves the fire house, the exhaust extraction system will ultimately place a tension force on the flexible hose. The force vectors are such due to the overhead arrangement of the extraction system, and in particular the balancer track, that the nozzle will experience both an upward pulling force as well as rearward pulling force. The upward force pulling on the end of the nozzle which is connected to the flexible hose pivots the magnets out of engagement with the exhaust pipe. This pivoting direction of separation is easier to accomplish than either full axial or lateral separation of the magnets due to the direction of the lines of flux and the relative ease or difficulty in breaking those lines of magnetic flux. The rocking or pivoting action allows the magnets to disengage quite easily. However, at the same time, if only axial forces were present, the force level required to separate the magnet housing from the exhaust pipe would be significant.

As the magnetic bond onto the exhaust pipe is broken, the axial force vectors pull the nozzle off of the locator ring. This procedure allows the nozzle to be securely retained at all times and yet separate easily when the fire truck is leaving the fire house.

When the truck returns to the fire house, the nozzle 24 can be readily reattached without any particular concerns as to alignment or possible damage. The pin/sleeve combination 75 along with the guide rail 45 ensure a proper and repeatable assembly.

Figure 11:
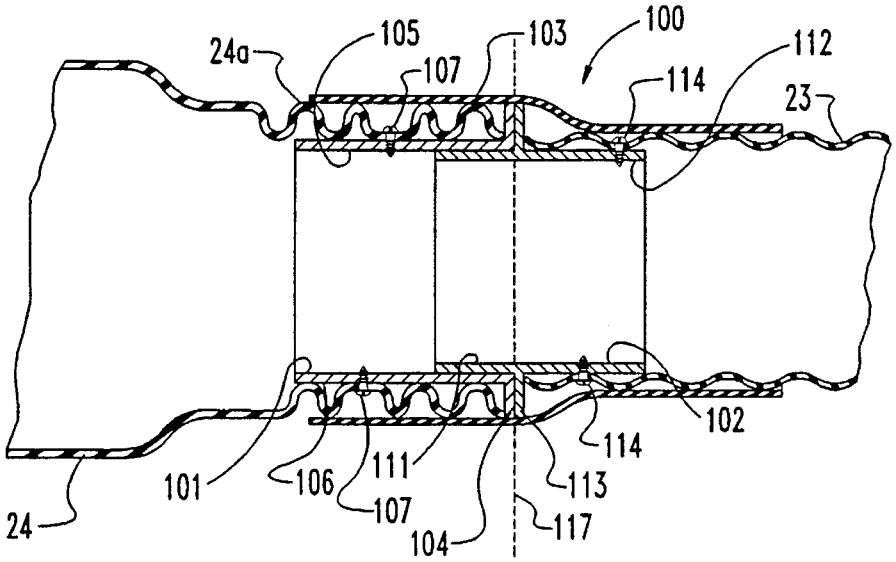
FIG. 11 is a side elevational view in full section of a safety connection feature which is suitable for use with the present invention.

Another feature of the present invention is to replace the connecting hose clamp 26 with the improved safety connection 100 which is illustrated in FIG. 11. Connection 100 includes a flanged nozzle sleeve 101, a flanged hose sleeve 102 and an outer rubber sleeve 103 which serves to hold the two sleeves 101 and 102 in abutment with each other.

Figure 12:
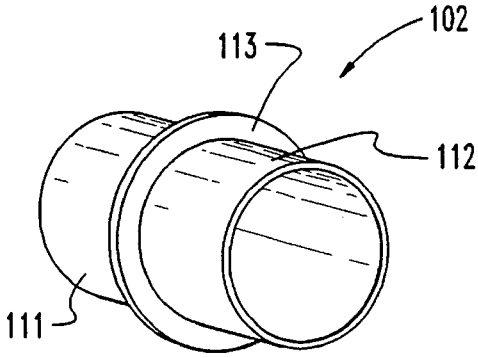
FIG. 12 is a perspective view of a nozzle sleeve which comprises one portion of the FIG. 11 connection.

Nozzle sleeve 101 (see FIG. 12) includes a cylindrical end flange 104 and concentric therewith a unitary, cylindrical sleeve portion 105. The outside diameter surface 106 of sleeve portion 105 fits within short section 24*a* and is attached thereto with screws 107. End flange 104 extends across the outer free end of short section 24*a*.

Figure 13:
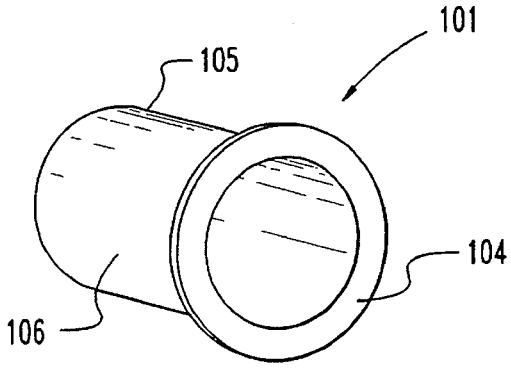
FIG. 13 is a perspective view of a flexible hose sleeve which comprises one portion of the FIG. 11 connection.

Hose sleeve 102 (see FIG. 13) includes a first cylindrical sleeve portion 111 and opposite thereto a second cylindrical sleeve portion 112. These two sleeve portions are separated by an intermediate, unitary cylindrical flange 113 which is concentric with each sleeve portion. Sleeve portion 111 is inserted into the hollow interior of nozzle sleeve 101 with a slip fit and flange 113 abuts up against end flange 104. Sleeve portion 112 fits inside of flexible hose 23 and is secured in position with screws 114.

In this described arrangement, the flexible hose 23 is readily separated from the short section 24*a* of the flexible hose. The nozzle sleeve 101 remains with the short section 24*a* and the hose sleeve 102 remains with the length of flexible hose 23. The separating or parting line coincides with the abutment plane (broken line 117) between end flange 104 and intermediate flange 113. In order to hold these two subassembly portions together in a gas-type combination, one end of rubber sleeve 103 is slipped over short section 24*a* and the opposite end of the rubber sleeve fits over flexible hose 23. The larger outside diameter size of the short section 24*a* as compared to flexible hose 23 results in a tighter grip on the short section 24*a*.

In operation the safety connection 100 has no effect if the nozzle 24 properly separates from the nozzle locator ring 25. However, if the nozzle 24 gets stuck or for some other reason will not release properly, greater tension will be placed on the flexible hose. As the fire truck continues to pull away from the fire house, the pulling force on flexible hose 23 increases. In order to prevent damage to the flexible hose or to the nozzle 24 or to some other portion of the overall assembly, some type of safety disconnect is desirable. By means of connection 100, the flexible hose 23 is able to pull out of the rubber sleeve 103. The rubber sleeve remains with the short section 24*a* but the two flanges come apart and the hose sleeve 102 pulls out of the rubber sleeve along with flexible hose 23. There is no damage done to the safety connection 100 as a consequence of this safety separation and all of the component parts can be readily reassembled.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A magnetically-attached nozzle assembly adapted to be used on a vehicle exhaust pipe as part of an exhaust extraction system, said nozzle assembly comprising:

a nozzle locator ring constructed and arranged to fit onto a vehicle exhaust pipe, said nozzle locator ring including an end wall and an outer wall; and an exhaust nozzle constructed and arranged with an inside surface which fits around said outer wall, said exhaust nozzle including a magnet housing attached to said inside surface and being constructed and arranged to magnetically contact a vehicle exhaust pipe.

2. The nozzle assembly of claim 1 wherein said nozzle locator ring further includes an inner wall which is spaced apart from and substantially concentric with said outer wall, said inner wall being constructed and arranged to fit over a vehicle exhaust pipe.

3. The nozzle assembly of claim 2 wherein said inner wall and said outer wall define an annular clearance space therebetween, said end wall defining a plurality of clearance holes which are arranged in air flow communication with said clearance space.

4. The nozzle assembly of claim 3 which further includes an annular flapper positioned in said annular clearance space and extending across said plurality of clearance holes,-said annular flapper constructed and arranged to admit air into said clearance space via said plurality of clearance holes and to block air flow out of said clearance space via said plurality of clearance holes.

5. The nozzle assembly of claim 4 wherein said magnet housing includes a frame and a plurality of magnets positioned within said frame.

6. The nozzle assembly of claim 5 wherein said magnet housing further includes a pair of magnet plates, said plurality of magnets being positioned between and magnetically attached to said pair of magnet plates.

7. The nozzle assembly of claim 6 wherein said plurality of magnets and said pair of magnet plates are moveable about a pivot pin.

8. The nozzle assembly of claim 1 wherein said magnet housing includes a frame and a plurality of magnets positioned within said frame.

9. The nozzle assembly of claim 8 wherein said magnet housing further includes a pair of magnet plates, said plurality of magnets being positioned between and magnetically attached to said pair of magnet plates.

10. The nozzle assembly of claim 9 wherein said plurality of magnets and said pair of magnet plates are moveable about a pivot pin.

11. An exhaust nozzle assembly adapted to be used on a vehicle exhaust pipe as part of an exhaust extraction system, said exhaust nozzle assembly comprising:

a nozzle locator ring constructed and arranged to be attached to a vehicle exhaust pipe, said nozzle locator ring constructed and arranged with an inner sleeve and spaced therefrom an outer sleeve; and an exhaust nozzle constructed and arranged to fit over said outer sleeve, said exhaust nozzle including a magnet housing with an attachment magnet therein, said attachment magnet being constructed and arranged so as to contact a vehicle exhaust pipe when said exhaust nozzle is assembled onto said nozzle locator ring.

12. The exhaust nozzle assembly of claim 11 wherein said inner sleeve is constructed and arranged to fit over a vehicle exhaust pipe, and said inner sleeve and said outer sleeve defining an annular clearance space therebetween.

13. The exhaust nozzle assembly of claim 12 which further includes an end flange integral with said inner sleeve and with said outer sleeve, said end flange defining a plurality of clearance holes which are arranged in air flow communication with said clearance space.

14. The exhaust nozzle assembly of claim 13 which further includes an annular flapper positioned in said annular clearance space and extending across said plurality of clearance holes, said annular flapper constructed and arranged to admit air into said clearance space via said plurality of clearance holes and to block air flow out of said clearance space via said plurality of clearance holes.

15. The exhaust nozzle assembly of claim 11 wherein said exhaust nozzle further includes a guide rail attached to an interior wall surface of said exhaust nozzle.

16. A magnetically-attached nozzle assembly adapted to be used on a vehicle exhaust pipe as part of an exhaust extraction system, said nozzle assembly comprising:

an annular nozzle locator ring constructed and arranged to fit onto a vehicle exhaust pipe, said nozzle locator ring including an end wall, a substantially annular outer wall, and a substantially annular inner wall which is spaced apart from and substantially concentric with said outer wall, said inner wall being constructed and arranged to fit over a vehicle exhaust pipe;

said inner wall and said outer wall defining an annular clearance space therebetween, said end wall defining a plurality of clearance holes which are arranged in air flow communication with said clearance space;

an exhaust nozzle constructed and arranged with an inside surface which fits around said substantially annular outer wall, said exhaust nozzle including a magnet housing attached to said inside surface and being constructed and arranged to magnetically contact a vehicle exhaust pipe; and an annular flapper positioned in said annular clearance space and extending across said plurality of clearance holes, said annular flapper constructed and arranged to admit air into said clearance space via said plurality of clearance holes and to block air flow out of said clearance space via said plurality of clearance holes.

17. A magnetically-attached nozzle assembly adapted to be used on a vehicle exhaust pipe as part of an exhaust extraction system, said nozzle assembly comprising:

an annular nozzle locator ring constructed and arranged to fit onto a vehicle exhaust pipe, said nozzle locator ring including an end wall and a substantially annular outer wall;

an exhaust nozzle constructed and arranged with an inside surface which fits around said substantially annular outer wall, said exhaust nozzle including a magnet housing attached to said inside surface and being constructed and arranged to magnetically contact a vehicle exhaust pipe; and an annular flapper positioned within said nozzle locator ring to control the flow of air through said nozzle locator ring and limit said flow of air to only one direction.

18. An exhaust nozzle assembly adapted to be used on a vehicle exhaust pipe as part of an exhaust extraction system, said exhaust nozzle assembly comprising:

a nozzle locator ring constructed and arranged to be attached to a vehicle exhaust pipe, said nozzle locator ring constructed and arranged with an inner sleeve and spaced therefrom a substantially concentric outer sleeve, said inner sleeve being constructed and arranged to fit over a vehicle exhaust pipe, said inner sleeve and said outer sleeve defining an annular clearance space therebetween;

said nozzle locator ring further including an end wall which is integral with said inner sleeve and said outer sleeve, said end wall defining a plurality of clearance holes which are arranged in air flow communication with said annular clearance space;

a flexible exhaust nozzle constructed and arranged to fit over said outer sleeve, said flexible exhaust nozzle including a magnet housing with an attachment magnet therein, said attachment magnet being constructed and arranged so as to contact a vehicle exhaust pipe when said flexible exhaust nozzle is assembled onto said nozzle locator ring; and an annular flapper positioned within said annular clearance space and extending across said plurality of clearance holes, said annular flapper constructed and arranged to admit air into said clearance space via said plurality of clearance holes and to block air flow out of said clearance space via said plurality of clearance holes.

19. An exhaust nozzle assembly adapted to be used on a vehicle exhaust pipe as part of an exhaust extraction system, said exhaust nozzle assembly comprising:

a nozzle locator ring constructed and arranged to be attached to a vehicle exhaust pipe, said nozzle locator ring constructed and arranged with an inner sleeve and spaced therefrom a substantially concentric outer sleeve;

a flexible exhaust nozzle constructed and arranged to fit over said outer sleeve, said flexible exhaust nozzle including a magnet housing with an attachment magnet therein, said attachment magnet being constructed and arranged so as to contact a vehicle exhaust pipe when said flexible exhaust nozzle is assembled onto said nozzle locator ring; and an annular flapper positioned within said nozzle locator ring to control the flow of air through said nozzle locator ring and limit said flow of air to only one direction.

20. A magnetically-attached nozzle assembly adapted to be used on a vehicle exhaust pipe as part of an exhaust extraction system, said nozzle assembly comprising:

a nozzle locator ring constructed and arranged to fit onto a vehicle exhaust pipe, said nozzle locator ring including an end wall and an outer wall;

an exhaust nozzle constructed and arranged with an inside surface which fits around said outer wall, said exhaust nozzle including a magnet housing attached to said inside surface and being constructed and arranged to magnetically contact a vehicle exhaust pipe; and an annular flapper positioned within said nozzle locator ring to control the flow of air through said nozzle locator ring and limit said flow of air to only one direction.

21. An exhaust nozzle assembly adapted to be used on a vehicle exhaust pipe as part of an exhaust extraction system, said exhaust nozzle assembly comprising:

a nozzle locator ring constructed and arranged to be attached to a vehicle exhaust pipe, said nozzle locator ring constructed and arranged with an inner sleeve and spaced therefrom an outer sleeve;

an exhaust nozzle constructed and arranged to fit over said outer sleeve, said exhaust nozzle including a magnet housing with an attachment magnet therein, said attachment magnet being constructed and arranged so as to contact a vehicle exhaust pipe when said exhaust nozzle is assembled onto said nozzle locator ring; and an annular flapper positioned within said nozzle locator ring to control the flow of air through said nozzle locator ring and limit said flow of air to only one direction.

* * * * *